US009303438B2

(12) United States Patent
Muir et al.

(10) Patent No.: US 9,303,438 B2
(45) Date of Patent: Apr. 5, 2016

(54) MULTI-BAR LINKAGE HINGE ASSEMBLY WITH LIMIT STOP

(71) Applicant: Caldwell Manufacturing Company North America, LLC, Rochester, NY (US)

(72) Inventors: Malcolm Muir, Honeoye Falls, NY (US); James McInnis, Hilton, NY (US); Jacob Snyder, Lancaster, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 0 days.

(21) Appl. No.: 14/454,788

(22) Filed: Aug. 8, 2014

(65) Prior Publication Data

US 2015/0040351 A1 Feb. 12, 2015

Related U.S. Application Data

(60) Provisional application No. 61/863,986, filed on Aug. 9, 2013.

(51) Int. Cl.

| | |
|---|---|
| ***E05D 15/30*** | (2006.01) |
| ***E05D 11/06*** | (2006.01) |
| ***E05D 15/40*** | (2006.01) |

(52) U.S. Cl.

CPC ..... *E05D 11/06* (2013.01); *E05D 15/406* (2013.01); *E05D 15/30* (2013.01); *E05Y 2600/10* (2013.01); *Y10T 16/5404* (2015.01); *Y10T 16/5478* (2015.01)

(58) Field of Classification Search

CPC ..... E05C 17/02; E05C 17/025; E05C 17/04; E05C 17/045; E05C 17/18; E05C 17/24; E05C 17/26; E05C 17/28; E05C 3/18; E05C 11/06; E05C 2700/12; E05C 15/28; E05C 15/30; E05C 15/32; E05C 15/34; E05C 15/42; E05C 15/44; E05C 15/46; Y10T 16/5478; Y10T 16/545; Y10T 16/5453; Y10T 16/5457; Y10T 16/5474; Y10T 16/5475; Y10T 16/5476

See application file for complete search history.

(56) References Cited

U.S. PATENT DOCUMENTS

| | | | | | |
|---|---|---|---|---|---|
| 4,689,852 | A * | 9/1987 | Buckley | E05D 15/44 | 16/341 |
| 4,833,754 | A * | 5/1989 | Yang | E05D 15/30 | 16/337 |
| 5,093,960 | A * | 3/1992 | Pemberton | E05D 15/30 | 16/360 |
| 5,711,052 | A * | 1/1998 | Delaske | E05D 15/30 | 16/245 |
| 5,898,977 | A * | 5/1999 | Muir | E05D 15/44 | 16/341 |
| 7,024,728 | B2 * | 4/2006 | Muir | E05D 15/44 | 16/221 |
| 2003/0046794 | A1 * | 3/2003 | Muir | E05D 15/44 | 16/366 |
| 2003/0046795 | A1 * | 3/2003 | Muir | E05D 15/44 | 16/366 |
| 2003/0150084 | A1 * | 8/2003 | Muir | E05D 15/44 | 16/366 |
| 2013/0104458 | A1 | 5/2013 | Leung et al. | | |

FOREIGN PATENT DOCUMENTS

| | | |
|---|---|---|
| GB | 2 246 393 | 1/1992 |
| GB | 2 278 398 | 11/1994 |
| GB | 2 404 692 | 2/2005 |
| GB | 2 498 598 | 7/2013 |

* cited by examiner

*Primary Examiner* — Jeffrey O Brien

(74) *Attorney, Agent, or Firm* — Harness, Dickey & Pierce, P.L.C.

(57) ABSTRACT

A hinge assembly for moving a window sash relative to a window frame may include a track, a slider, first, second and third links, and a stop member. The slider may engage the track and may be translatable along the track. The first link may be pivotably coupled to the track. The second link may be pivotably coupled to the slider. The third link may be pivotably coupled to the first and second links. The stop member may engage the track and may be configured to limit translational motion of the slider. The stop member may be movable between a plurality of positions. Each of the plurality of positions may correspond to one of a plurality of ranges of translational motion of the slider.

19 Claims, 6 Drawing Sheets

MULTI-BAR LINKAGE HINGE ASSEMBLY WITH LIMIT STOP

CROSS-REFERENCE TO RELATED APPLICATIONS

This application claims the benefit of U.S. Provisional Application No. 61/863,986, filed on Aug. 9, 2013. The entire disclosure of the above application is incorporated herein by reference.

FIELD

The present disclosure relates to a hinge assembly for a window, and more particularly, to a multi-bar linkage hinge assembly with a limit stop.

BACKGROUND

This section provides background information related to the present disclosure and is not necessarily prior art.

Multi-bar linkage hinge assemblies may be employed in casement-type or projection-type window assemblies, for example. Such hinge assemblies may allow pivotal movement of a window vent or sash relative to a window frame. In projection-type window assemblies, first and second hinge assemblies may be disposed on respective first and second vertically extending sides of the window sash. In casement-type window assemblies, first and second hinge assemblies may be disposed on respective upper and lower horizontally extending sides of the window sash.

SUMMARY

This section provides a general summary of the disclosure, and is not a comprehensive disclosure of its full scope or all of its features.

In one form, the present disclosure provides a hinge assembly for moving a window sash relative to a window frame may include a track, a slider, first, second and third links, and a stop member. The slider may engage the track and may be translatable along the track. The first link may be pivotably coupled to the track. The second link may be pivotably coupled to the slider. The third link may be pivotably coupled to the first and second links. The stop member may engage the track and may be configured to limit translational motion of the slider. The stop member may be movable between a plurality of positions. Each of the plurality of positions may correspond to one of a plurality of ranges of translational motion of the slider.

In some embodiments, the stop member may include a first end disposed between the slider and a pin pivotably coupling the first link to the track and a second end disposed on an opposite side of the pin from the first end.

In some embodiments, the pin may extend through a slot formed in the stop member.

In some embodiments, a fastener may be received through an opening (e.g., an aperture or slot) in the stop member and may fix the stop member relative to the track. The opening may be disposed on the opposite side of the pin from the first end of the stop member.

In some embodiments, the track may include an opening that is aligned with the opening in the stop member and configured to receive the fastener. In some embodiments, the opening in the track may be a slot or an aperture, for example.

In some embodiments, the hinge assembly may include a fourth link pivotably coupled to the slider and the first link. In some embodiments, the second and fourth links may be pivotable relative to the slider about a common axis.

In some embodiments, the first link may be translationally fixed relative to the track.

In some embodiments, the track may be configured to fixedly engage the window frame and the third link may be configured to fixedly engage the window sash.

In another form, the present disclosure provides a hinge assembly for moving a window sash relative to a window frame. The hinge assembly may include a track, a slider, a vent bar, a link and a stop member. The slider may engage the track and may be translatable along the track. The vent bar may be pivotably coupled to the slider for rotation relative to the slider and movement with the slider relative to the track. The link may include a first end coupled to the track for rotation relative to the track about an axis and a second end coupled to the vent bar for rotational relative to the vent bar and the slider. The stop member may engage the track and may be configured to limit translational motion of the slider. The stop member may be movable between a plurality of positions. Each of the plurality of positions may correspond to one of a plurality of ranges of translational motion of the slider.

In some embodiments, the stop member may include a first end disposed between the slider and a pin pivotably coupling the link to the track and a second end disposed on an opposite side of the pin from the first end.

In some embodiments, the pin may extend through a slot formed in the stop member.

In some embodiments, a fastener may be received through an opening (e.g., an aperture or slot) in the stop member and may fix the stop member relative to the track. The opening may be disposed on the opposite side of the pin from the first end of the stop member.

In some embodiments, the track may include an opening that is aligned with the opening in the stop member and configured to receive the fastener. In some embodiments, the opening may be a slot or an aperture, for example.

In some embodiments, the hinge assembly may include a brace pivotably coupled to the slider and the link.

In some embodiments, hinge assembly may include a connector pivotable coupled to the slider and the vent bar. The brace and the connector may be pivotable relative to the slider about a common axis.

In some embodiments, the axis about which the first end of the link pivots may be fixed relative to the track.

In some embodiments, the track may be configured to fixedly engage the window frame and the vent bar may be configured to fixedly engage the window sash.

In another form, the present disclosure provides a hinge assembly for moving a window sash relative to a window frame. The hinge assembly may include a linkage and a stop member. The linkage may include a stationary first member, a second member that may be linearly movable relative to the first member, a third member that may be pivotably coupled to the first member, and a fourth member that may be pivotably coupled to the second member and pivotably coupled to the third member. The third member may be pivotable about an axis that extends though the first member and may be fixed relative to the first member. The stop member may engage the first member and may include a first end disposed between the axis and the second member and a second end disposed on an opposite side of the axis from the second member. The stop member may abut the second member when the linkage is in an open position to limit linear motion of the second member.

In some embodiments, the stop member may be movable between a plurality of positions. Each of the plurality of positions may correspond to one of a plurality of ranges of linear motion of the second member.

In some embodiments, the first member may be configured to fixedly engage the window frame and the fourth member may be configured to fixedly engage the window sash.

In some embodiments, the stop member may be movable among an infinite number of positions between two opposing ends of a slot formed in the first member or the stop member. Each of the positions may correspond to one of a plurality of ranges of linear motion of the second member.

In some embodiments, the first member may include a plurality of first apertures and the stop member may include a plurality of second apertures that are selectively alignable with one or more of the first apertures to selectively fix the stop member at a selected one of a plurality of positions relative to the first member. Each of the positions may correspond to one of a plurality of ranges of linear motion of the second member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
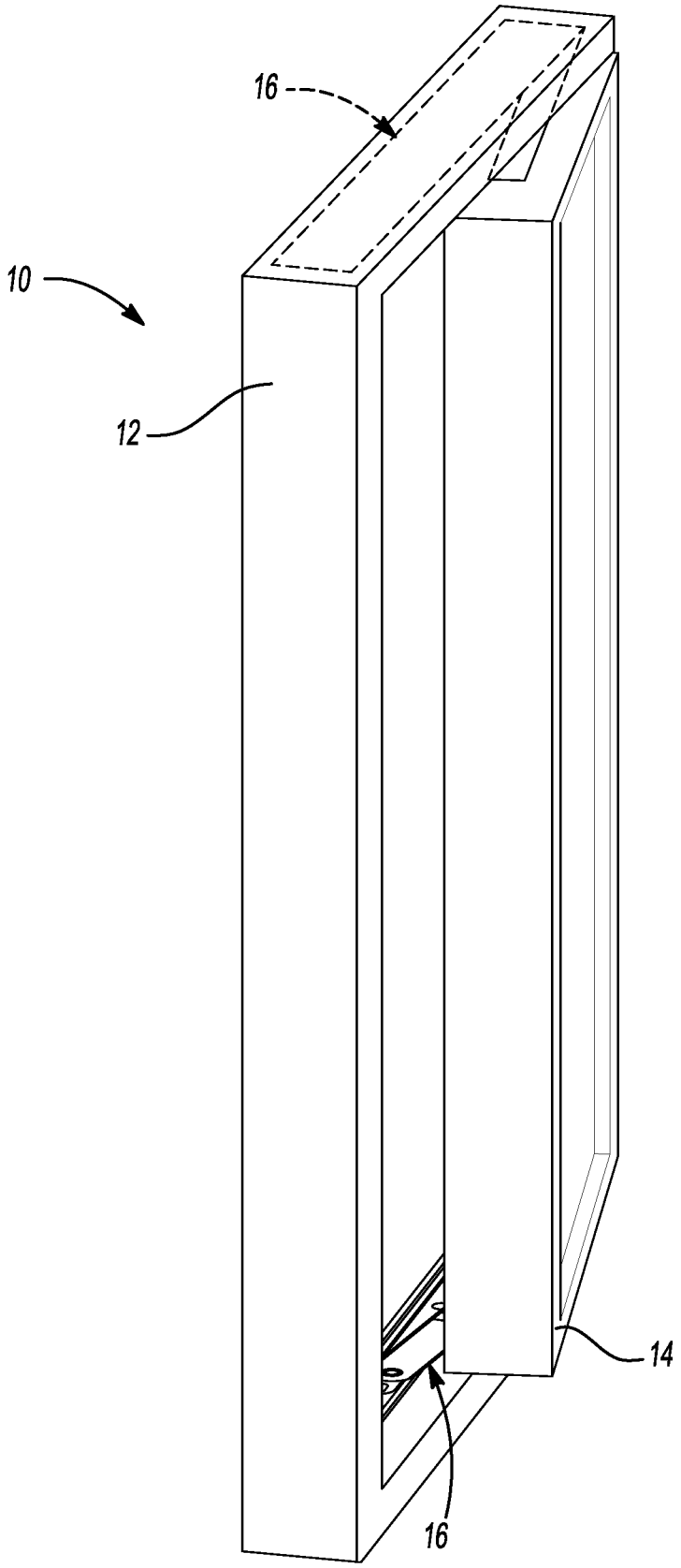
FIG. 1 is a perspective view of a window assembly having hinge assemblies according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
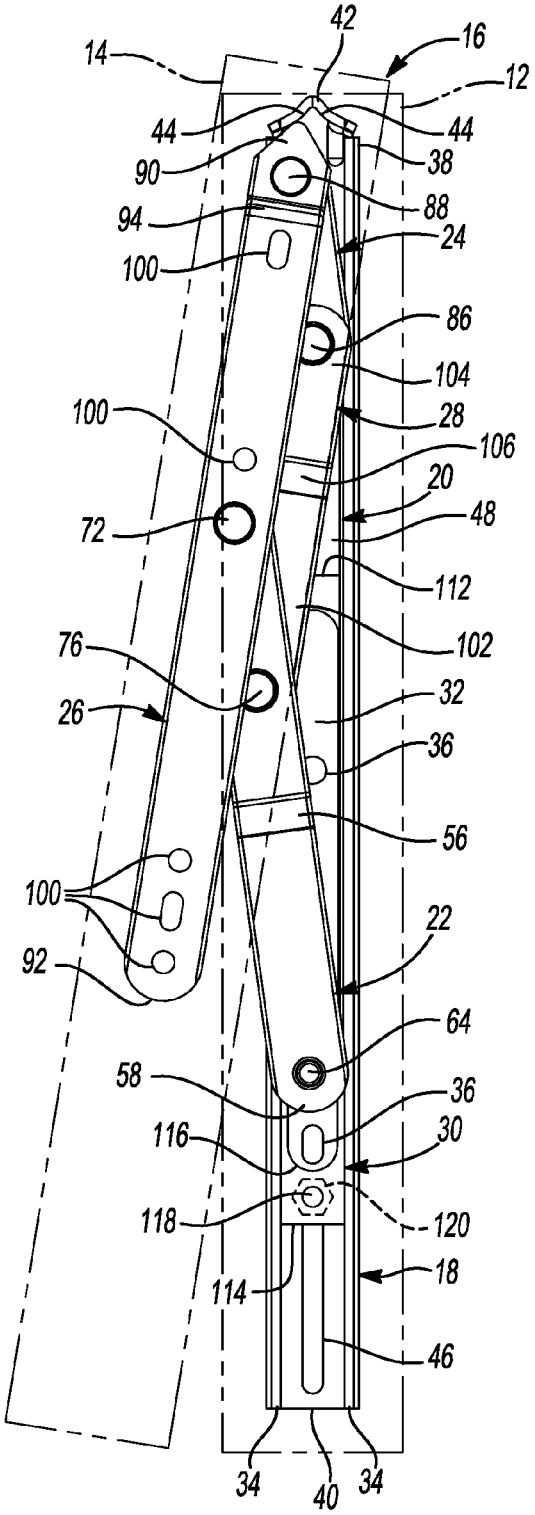
FIG. 2 is a plan view of one of the hinge assemblies of FIG. 1 in a fully open position as defined by a stop member being positioned in a first location.
Figure 3:
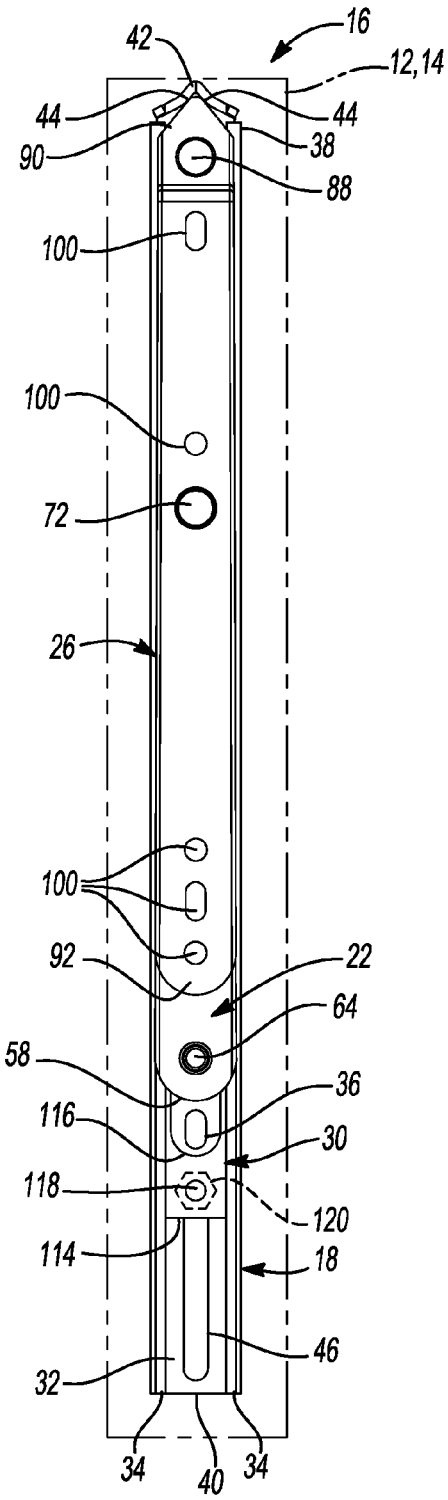
FIG. 3 is a plan view of the hinge assembly of FIG. 2 in a closed position.

With reference to FIG. 1, a window assembly 10 is provided that may include a window frame 12, a window vent or sash 14, and a pair of hinge assemblies 16 (shown schematically in FIG. 1). The hinge assemblies 16 allow the window sash 14 to move relative to the window frame 12 between an open position (FIGS. 1 and 2) and a closed position (FIG. 3). The window assembly 10 shown in FIG. 1 is a casement-type window assembly. Therefore, the hinge assemblies 16 may be disposed on sides of the window sash 14. However, it will be appreciated that the hinge assemblies 16 could be incorporated into other types of window assemblies, such as a projection-type window assembly, for example.

Referring now to FIGS. 2-6, each of the hinge assemblies 16 may be a multi-bar linkage and may include a track 18, a slider 20, a strut or first link 22, a connector or second link 24, a vent bar or third link 26, a brace or fourth link 28, and a stop member or limit stop 30. The slider 20, strut 22, connector 24, vent bar 26 and brace 28 may be movable relative to the track 18 between an open position (FIG. 2) and a closed position (FIG. 3). As will be subsequently described, the stop member 30 may limit a range of motion of the slider 20 relative to the track 18, thereby limiting an angle to which the window sash 14 can be opened relative to the window frame 12 (i.e., limiting a range of motion of the window sash 14 relative to the window frame 12).

The track 18 may include an elongated body 32 having parallel side flanges 34 extending therefrom. The body 32 and side flanges 34 may cooperate to form a channel 35 (FIG. 5) that receives the slider 20 and the stop member 30. The body 32 may include a plurality of apertures and/or slots 36 through which fasteners (not shown) may extend to fixedly secure the track 18 to the window frame 12. The track 18 may include a first end 38 and a second end 40. An end cap 42 may fixedly engage the first end 38 and may include a pair of camming surfaces 44 that the vent bar 26 may movably contact. A slot 46 may extend through the body 32 between an aperture 47 (FIG. 5) and the second end 40 of the track 18.

Figure 5:
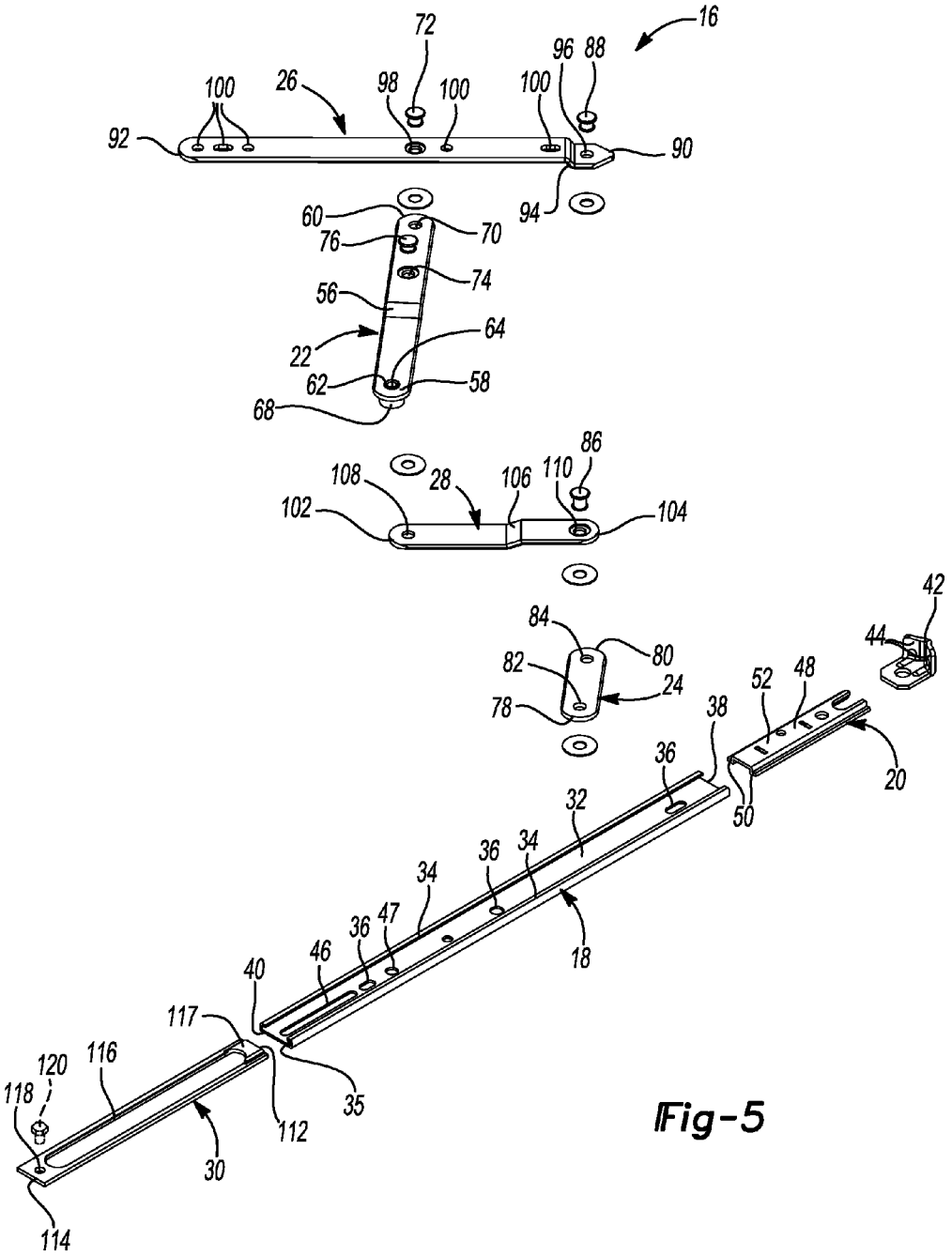
FIG. 5 is an exploded perspective view of the hinge assembly.
Figure 6:
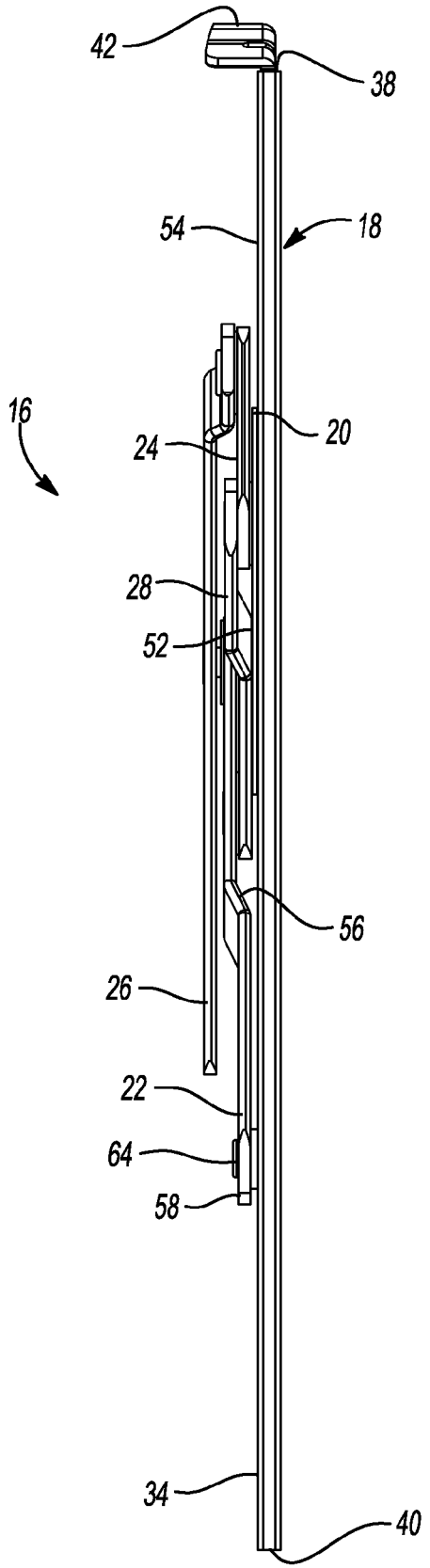
FIG. 6 is a side view of the hinge assembly.

The slider 20 may slidably engage the track 18 and may include a body 48 and a pair of flanges 50 (FIG. 5) extending laterally outward from the body 48. The flanges 50 may fit between the body 32 and side flanges 34 of the track 18, thereby retaining the slider 20 in the channel 35 of the track 18. A side of the body 48 of the slider 20 that faces the body 32 of the track 18 may include a cavity formed therein. A friction adjuster pad (not shown) may be mounted within the cavity and may be adjustable therein to adjust an amount of sliding friction between the body 32 of the track 18 and the body 48 of the slider 20. A side 52 of the body 48 of the slider 20 that faces away from the track 18 may be flush with or raised slightly above the top surfaces 54 of the side flanges 34, as shown in FIG. 6. The slider 20 may be formed from brass, for example, so that the slider 20 smoothly and durably slides within the track 18. It will be appreciated, however, that the slider 20 could be formed from any other suitable metallic, polymeric or composite material, for example. The track 18, strut 22, connector 24, vent bar 26 and brace 28 may be formed from steel, for example, or any other suitable metallic, polymeric or composite material.

The strut 22 may be a generally linear bar having a step 56 between first and second ends 58, 60. The first end 58 may be pivotably coupled to the track 18 and may include a first aperture 62. A first pivot pin 64 may engage the first aperture 62 and the aperture 47 (FIG. 5) in the track 18 and may define a first axis A1 (FIG. 4) about which the strut 22 is rotatable relative to the track 18. The first axis A1 may be fixed relative to the track 18 during motion of the hinge assembly 16 between the open and closed positions. A bearing washer and/or bushing 68 may receive the first pivot pin 64 between the strut 22 and the track 18. The second end 60 of the strut 22 may be pivotably coupled to the vent bar 26. The second end 60 may include a second aperture 70 (FIG. 5) that receives a second pivot pin 72 that defines a second axis A2 (FIG. 4) about which the strut 22 and the vent bar 26 are pivotable relative to each other. A third aperture 74 (FIG. 5) may be formed in the strut 22 between the step 56 and the second end 60. The third aperture 74 may receive a third pivot pin 76 that defines a third axis A3 (FIG. 4) about which the strut 22 and the brace 28 are pivotable relative to each other.

The connector 24 may be a flat, linear bar having first and second ends 78, 80. The first and second ends 78, 80 may include first and second apertures 82, 84 (FIG. 5), respectively. The first aperture 82 may receive a fourth pivot pin 86 that defines a fourth axis A4 (FIG. 4) about which the connector 24 pivots relative to the slider 20 and about which the connector 24 and the brace 28 are pivotable relative to each other. The second aperture 84 may receive a fifth pivot pin 88 that defines a fifth axis A5 (FIG. 4) about which the connector 24 and the vent bar 26 are pivotable relative to each other.

The vent bar 26 may include first and second ends 90, 92 and a step 94 disposed proximate the first end 90. The first end 90 may include a first aperture 96 (FIG. 5) that receives the fifth pivot pin 88 to allow for relative pivotable motion between the vent bar 26 and the connector 24. A second aperture 98 (FIG. 5) may be disposed between the step 94 and the second end 92 and may receive the second pivot pin 72 to allow for relative pivotable motion between the vent bar 26 and the strut 22. The vent bar 26 may include a plurality of slots and/or apertures 100 disposed between the first and second ends 90, 92 that engage fasteners (not shown) for fixedly securing the window sash 14 to the vent bar 26. The first end 90 may include angled surfaces 101 that may slidably contact the camming surfaces 44 of the end cap 42. A tip of the first end 90 may be nested between the camming surfaces 44 when the hinge assembly 16 is in the closed position (as shown in FIG. 3).

The brace 28 may include first and second ends 102, 104 and a step 106 disposed between the first and second ends 102, 104. The first end 102 may include a first aperture 108 (FIG. 5) that receives the third pivot pin 76 to allow for relative pivotable motion between the brace 28 and the strut 22. The second end 104 may include a second aperture 110 (FIG. 5) that receives the fourth pivot pin 86 to allow for relative pivotable motion between the brace 28 and the connector 24 and relative pivotable motion between the brace 28 and the slider 20. It will be appreciated that, in some embodiments, the hinge assembly 16 may not include the brace 28. It will also be appreciated that the linkage of the hinge assembly 16 could be configured in a variety of different ways.

The stop member 30 may be received in the channel 35 of the track 18 between the strut 22 and the body 32 of the track 18. The stop member 30 may be adjustably fixed relative to the track 18 in a desired one of a plurality of positions. The stop member 30 may be a generally flat and linear bar including first and second ends 112, 114. An elongated slot 116 may extend through the stop member 30 between the first and second ends 112, 114. The first pivot pin 64 and the bushing 68 may extend through the slot 116. In this manner, the first end 112 may be disposed between the slider 20 and the first pivot pin 64, and the second end 114 may be disposed on an opposite side of the first pivot pin 64 from the slider 20 and the first end 112 (i.e., the second end 114 may be disposed between the first pivot pin 64 and the second end 40 of the track 18). In some embodiments, the first end 112 may include a raised portion 117 (FIG. 5). The slider 20 may abut the raised portion 117 in the open position.

The stop member 30 may include an aperture 118 extending therethrough between the slot 116 and the second end 114. A fastener 120 (FIG. 2) may extend through the aperture 118 and the slot 46 in the track 18 and may engage the window frame 12 to fix the stop member 30 relative to the track 18. Prior to tightening the fastener 120 against the stop member 30, the stop member 30 may be slid within the channel 35 of the track 18 to a desired one of a plurality of positions. Once the stop member 30 is moved to the desired position, the fastener 120 can be tightened against the stop member 30 to clamp the stop member 30 against the track 18.

Figure 7:
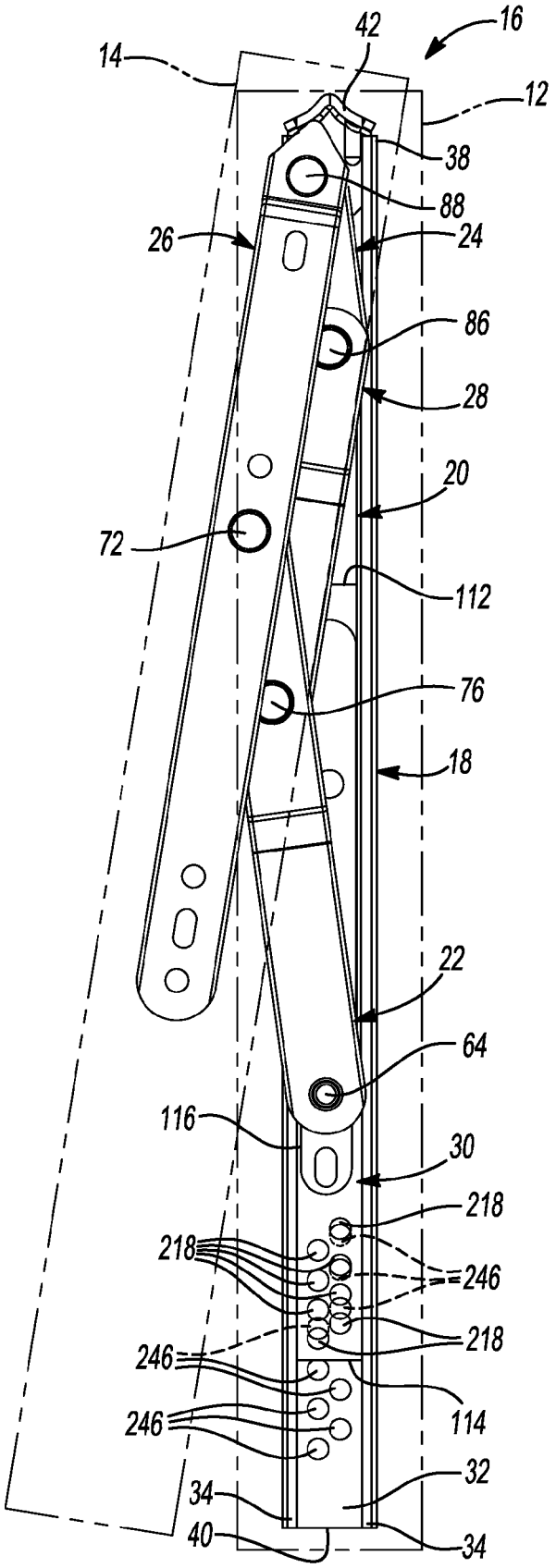
FIG. 7 is a plan view of another hinge assembly including a stop member and track including groups of selectively alignable apertures for securing the stop member in a selected one of a plurality of discrete positions relative to the track.

While the FIGs. depict the stop member 30 including a single aperture 118 disposed between the slot 116 and the second end 114, in some embodiments, the stop member 30 could include a plurality of apertures 218 (as shown in FIG. 7) and/or one or more slots disposed between the slot 116 and the second end 114 that may be selectively aligned with the slot 46 in the track 18 and/or one or more holes 246 (as shown in FIG. 7) and/or slots formed in the track 18 between the first axis A1 and the second end 40 of the track 18. Such holes and/or slots could receive one or more fasteners that secure the stop member 30 relative to the track 18. In some embodiments, the stop member 30 could include one or more slots or apertures disposed between the slot 116 and the first end 112 that could receive one or more fasteners for securing the stop member 30 relative to the track 18.

Figure 4:
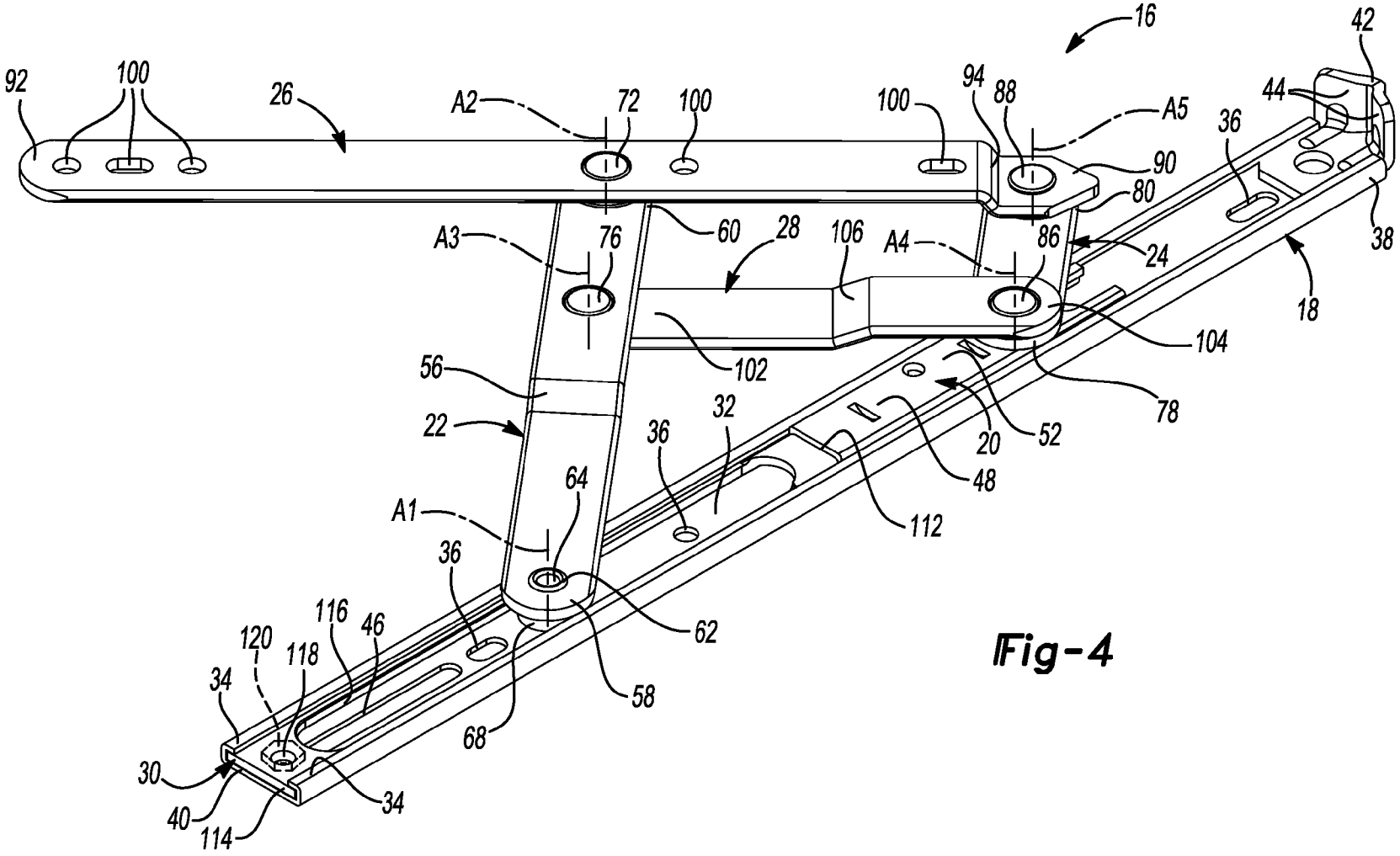
FIG. 4 is a perspective view of the hinge assembly in a fully open position as defined by the stop member being positioned in a second location.

With continued reference to FIGS. 1-6, operation of the hinge assembly 16 will be described in detail. As shown in FIGS. 2 and 3, the slider 20, strut 22, connector 24, vent bar 26 and brace 28 may be movable relative to the track 18 between the open position (FIG. 2) and the closed position (FIG. 3) to move the window sash 14 between the open and closed positions. As shown in FIGS. 2 and 4, the body 48 of the slider 20 may abut the first end 112 of the stop member 30 when the hinge assembly 16 is in the open position. In this manner, the stop member 30 limits the range of translational motion of the slider 20, thereby limiting the range of motion of the strut 22, connector 24, vent bar 26 and brace 28 and limiting the angle to which the window sash 14 can be opened relative to the window frame 12.

Therefore, changing the position of the stop member 30 relative to the track 18 will change the position of the slider 20 (and the positions of the strut 22, connector 24, vent bar 26 and brace 28) in the open position. Fixing the stop member 30 in a position relatively close to the second end 40 of the track 18 (e.g., as shown in FIG. 4) will increase a range over which the slider 20 can translate relative to the track 18, and fixing the stop member in a position relatively farther from the second end 40 of the track 18 (e.g., as shown in FIG. 2) will decrease the range over which the slider 20 can translate relative to the track 18. In the particular embodiment depicted in the FIGs., the length of the slot 46 in the track 18 defines the range of positions at which the stop member 30 can be fixed relative to the track 18. That is, aligning the aperture 118 with an end of the slot 46 closest to the first axis A1 will result in the least amount of travel of the slider 20 (and the least amount that the window sash 14 can be opened), and aligning the aperture 118 with an end of the slot 46 closest to the second end 40 of the track 18 will result in the greatest amount of travel of the slider 20 (and the greatest amount that the window sash 14 can be opened). It will be appreciated that the length of the slot 46 in the track 18 and/or the length of the slot 116 in the stop member 30 can be greater than or less than the lengths shown in the figures to provide a desired range of adjustability of the stop member 30 relative to the track 18.

Providing the aperture 118, fastener 120 and slot 46 at a location between the first axis A1 and the second end 40 of the track 18 provides easier access to the fastener 120 after the hinge assembly 16 has been installed in the window assembly 10. This makes it easier for manufacturers, installers, and/or end users of the window assembly 10 to adjust the position of the stop member 30 (and hence, the angle to which the window sash 14 can be opened) after installation of the hinge assemblies 16 and/or after installation of the window assembly 10 in a house or building. For example, if a person wanted to set the stop member 30 at a position that allowed only a small amount of travel of the slider 20, access to the stop member 30 between the slider 20 and the first axis A1 would be hindered by the strut 22, the brace 28 and/or the window sash 14. However, because the fastener 120 is disposed between the first axis A1 and the second end 40 of the track, the fastener 120 is still easily accessible, even when the window sash 14 is only open a small amount.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A hinge assembly for moving a window sash relative to a window frame, the hinge assembly comprising:

a track;

a slider engaging the track and translatable along the track;

a first link pivotably coupled to the track;

a second link pivotably coupled to the slider;

a third link pivotably coupled to the first and second links; and a stop member engaging the track and configured to limit translational motion of the slider, the stop member being movable between a plurality of positions, each of the plurality of positions corresponding to one of a plurality of ranges of translational motion of the slider; and wherein the stop member includes first and second ends, the first end is disposed between the slider and a pin pivotably coupling the first link to the track, the second end is disposed on an opposite side of the pin from the first end.

2. The hinge assembly of claim 1, wherein the pin extends through a slot formed in the stop member.

3. The hinge assembly of claim 1, wherein a fastener is received through an opening in the stop member and fixes the stop member relative to the track, the opening is disposed on the opposite side of the pin from the first end of the stop member.

4. The hinge assembly of claim 3, wherein the track includes an opening that is aligned with the opening in the stop member and configured to receive the fastener.

5. The hinge assembly of claim 4, wherein the opening in the track is a slot.

6. The hinge assembly of claim 1, further comprising a fourth link pivotably coupled to the slider and the first link.

7. The hinge assembly of claim 6, wherein the second and fourth links are pivotable relative to the slider about a common axis.

8. The hinge assembly of claim 1, wherein the first link is translationally fixed relative to the track.

9. A hinge assembly for moving a window sash relative to a window frame, the hinge assembly comprising:

a track;

a slider engaging the track and translatable along the track;

a vent bar pivotably coupled to the slider for rotation relative to the slider and movement with the slider relative to the track;

a link including a first end coupled to the track for rotation relative to the track about an axis and a second end coupled to the vent bar for rotational relative to the vent bar and the slider; and a stop member engaging the track and configured to limit translational motion of the slider, the stop member being movable between a plurality of positions, each of the plurality of positions corresponding to one of a plurality of ranges of translational motion of the slider; and wherein the stop member includes first and second ends, the first end of the stop member is disposed between the slider and a pin pivotably coupling the link to the track, the second end of the stop member is disposed on an opposite side of the pin from the first end.

10. The hinge assembly of claim 9, wherein the pin extends through a slot formed in the stop member.

11. The hinge assembly of claim 9, wherein a fastener is received through an opening in the stop member and fixes the stop member relative to the track, the opening is disposed on the opposite side of the pin from the first end of the stop member.

12. The hinge assembly of claim 11, wherein the track includes an opening that is aligned with the opening in the stop member and configured to receive the fastener.

13. The hinge assembly of claim 12, wherein the opening in the track is a slot.

14. The hinge assembly of claim 9, further comprising a brace pivotably coupled to the slider and the link.

15. The hinge assembly of claim 14, further comprising a connector pivotably coupled to the slider and the vent bar, wherein the brace and the connector are pivotable relative to the slider about a common axis.

16. The hinge assembly of claim 9, wherein the axis is fixed relative to the track.

17. A hinge assembly for moving a window sash relative to a window frame, the hinge assembly comprising:

a linkage including a stationary first member, a second member that is linearly movable relative to the first member, a third member that is pivotably coupled to the first member, and a fourth member that is pivotably coupled to the second member and pivotably coupled to the third member, the third member being pivotable about an axis that extends though the first member and is fixed relative to the first member; and a stop member engaging the first member and including a first end disposed between the axis and the second member and a second end disposed on an opposite side of the axis from the second member, the stop member abutting the second member when the linkage is in an open position to limit linear motion of the second member wherein the stop member is movable between a plurality of positions, each of the plurality of positions corresponding to one of a plurality of ranges of linear motion of the second member.

18. A hinge assembly for moving a window sash relative to a window frame, the hinge assembly comprising:

a linkage including a stationary first member, a second member that is linearly movable relative to the first member, a third member that is pivotably coupled to the first member, and a fourth member that is pivotably coupled to the second member and pivotably coupled to the third member, the third member being pivotable about an axis that extends though the first member and is fixed relative to the first member; and a stop member engaging the first member and including a first end disposed between the axis and the second member and a second end disposed on an opposite side of the axis from the second member, the stop member abutting the second member when the linkage is in an open position to limit linear motion of the second member; and wherein the stop member is movable among an infinite number of positions between two opposing ends of a slot formed in the first member or the stop member, each of the positions corresponding to one of a plurality of ranges of linear motion of the second member.

19. The hinge assembly of claim 17, wherein the first member includes a plurality of first apertures and the stop member includes a plurality of second apertures that are selectively alignable with one or more of the first apertures to selectively fix the stop member at a selected one of a plurality of positions relative to the first member, each of the positions corresponding to one of a plurality of ranges of linear motion of the second member.

* * * * *